US009598804B1

(12) United States Patent
Fishburn

(10) Patent No.: US 9,598,804 B1
(45) Date of Patent: Mar. 21, 2017

(54) LONGARM QUILTING MACHINE WITH BATTING HAMMOCK

(71) Applicant: Lynnette Salveson Fishburn, Alexandria, VA (US)

(72) Inventor: Lynnette Salveson Fishburn, Alexandria, VA (US)

( * ) Notice: Subject to any disclaimer, the term of this patent is extended or adjusted under 35 U.S.C. 154(b) by 0 days.

(21) Appl. No.: 14/967,505

(22) Filed: Dec. 14, 2015

(51) Int. Cl.
*D05B 11/00* (2006.01)
*D05B 41/00* (2006.01)
*D05B 39/00* (2006.01)

(52) U.S. Cl.
CPC ..... *D05B 11/00* (2013.01); *D05B 39/00* (2013.01); *D05B 39/005* (2013.01); *D05B 41/00* (2013.01)

(58) Field of Classification Search
CPC ..... D05B 75/00; D05B 75/02; D05B 11/00; D05B 39/00; D05B 39/005; D05B 41/00; D05B 25/00
See application file for complete search history.

(56) References Cited

U.S. PATENT DOCUMENTS 413,811 A * 10/1889 Palmer, Jr. ..... A47G 9/0207 112/117
1,069,212 A * 8/1913 Wilcox ..... D05B 75/02 112/217.1
1,732,660 A * 10/1929 Root ..... D05B 39/005 38/102.21
2,637,918 A * 5/1953 Mayhew ..... D06F 81/006 108/26
3,045,742 A * 7/1962 Brooks ..... B32B 27/00 156/202
4,649,842 A * 3/1987 Backmann ..... D05B 11/00 112/117
5,603,270 A * 2/1997 White ..... D05B 11/00 112/117
2014/0190047 A1* 7/2014 McCoy ..... D05B 11/00 38/102.91

* cited by examiner

*Primary Examiner* — Ismael Izaguirre

(57) ABSTRACT

A fabric hammock provides storage for feeding a batting layer into a quilting frame. Compared to a conventional supply roll wound onto a roller, the hammock is easily loaded and automatically maintains constant low tension while feeding the batting material to the quilting frame. Compared to a conventional arrangement allowing the batting material to hang down to the floor, the hammock keeps the batting material off the floor and out from underfoot.

1 Claim, 4 Drawing Sheets

FIG. 1 -PRIOR ART-

FIG. 2 -PRIOR ART-

FIG. 3 -PRIOR ART-

LONGARM QUILTING MACHINE WITH BATTING HAMMOCK

BACKGROUND

A quilt commonly consists of three layers—a quilt top, quilt batting, and a quilt backing—bound together by an intricate stitching pattern. The top layer is often an artful patchwork of smaller fabric pieces. The batting is a layer of insulating material, such as cotton, polyester or wool. The backing may be a single piece of fabric.

Historically, the three layers were laboriously stitched together by hand, or by an ordinary sewing machine. In recent years, a specialized piece of equipment, the longarm quilting machine, has come into use, making the assembling of the three layers a much quicker and efficient process. The existence of the longarm quilting machine has led to a division of labor in which piecers, or sewists, prepare only the quilt top, which is handed off to a professional longarm quilter, who for a fee finishes it by binding it to batting and backing layers. The efficiency, speed and high quality of these quilt-finishing services have led to a surge of interest in quilting.

Referring to FIGS. 1 and 2, a longarm quilting machine comprises a longarm sewing machine 100 with handles 101, resting on table 106. The finished quilt 211 accumulates on a take-up roller 107, which is supported by supports 102. The top layer supply roll 212 unwinds from roller 108, which is supported by supports 103. The bottom layer supply roll 213 unwinds from roller 109, which is supported on supports 104. The batting layer supply roll 214 unwinds from roller 110, which is supported by supports 105.

The longarm sewing machine rests on wheels 210 which allow the longarm sewing machine to be moved towards and away from the operator, between the supply rollers 108, 109 and 110, and the take-up roller 107. Additional wheels allow travel in a transverse direction.

One problem plaguing existing longarm quilting machine is associated with the handling of the batting layer. Placing the batting insulation layer 207 as a roll 214 on roller 110 is problematical for two reasons. First, loading the batting onto the roller is difficult because batting is supplied in rolls, in which the batting has been folded over once before being rolled up. Secondly, and more importantly, batting is delicate with low tensile strength. This means that pulling batting off the roller, as it is fed to the sewing machine, can stretch, distort, or even tear it. Any excessive tension in the batting layer is likely to cause a distortion in the flatness of the overall quilt. At best, this causes more work for the longarm operator. At worst, it can damage the overall finished product.

Referring to FIG. 3, some longarm operators have resorted to simply letting the batting layer 207 hang down (311) to the floor, rather than rolling it onto the roller 110. This solves the problem of excessive tension, but of course the batting can pick up dirt or other debris from the floor, and the operator might step on it.

Therefore there is a need, which has not been addressed before the present, for a way to feed batting into a quilting machine without unduly tensioning it or allowing it to drag on the floor.

SUMMARY

A hammock attached to a quilting machine stores a supply of batting insulation. The batting is easily loaded into the hammock. It stays there in a folded configuration that allows it to be drawn out with a constant low tension.

DRAWINGS—FIGURES

DRAWINGS—REFERENCE NUMERALS

100—longarm sewing machine
101—longarm sewing machine handles
102—finished quilt take-up roller support arm
103—top layer roller support arm
104—bottom layer roller support arm
105—batting layer roller support arm
106—table
107—finished quilt take-up roller
108—top layer supply roller
109—bottom layer supply roller
110—batting layer supply roller
207—batting layer
208—top layer
209—bottom layer
210—longarm sewing machine wheels
211—finished quilt
212—top layer supply roll
213—bottom layer supply roll
214—batting layer supply roll
311—batting layer resting on floor
412—hammock support wires
413—hammock fabric
414—hammock mouth brace
415—batting layer folded within hammock

DETAILED DESCRIPTION

Figure 1:
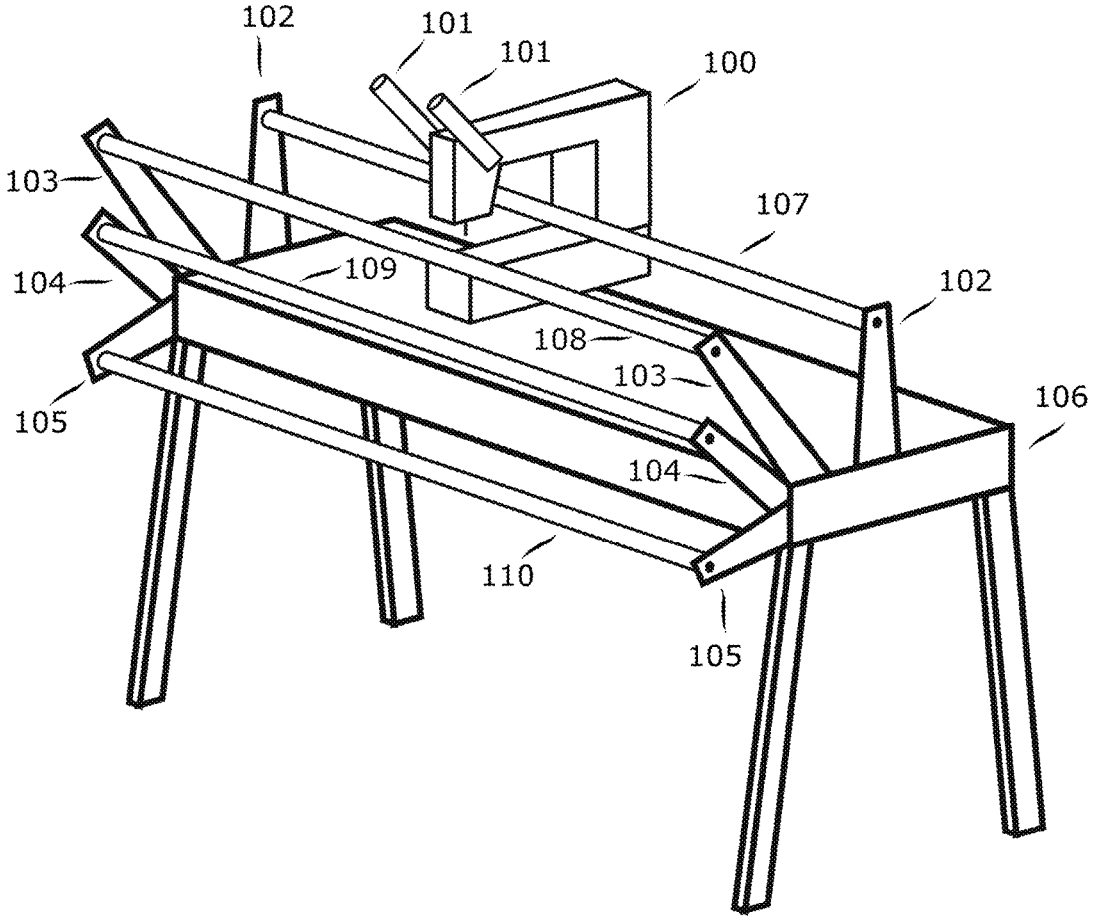
FIG. 1 (Prior Art) is a three-dimensional view of a longarm quilting machine.
Figure 2:
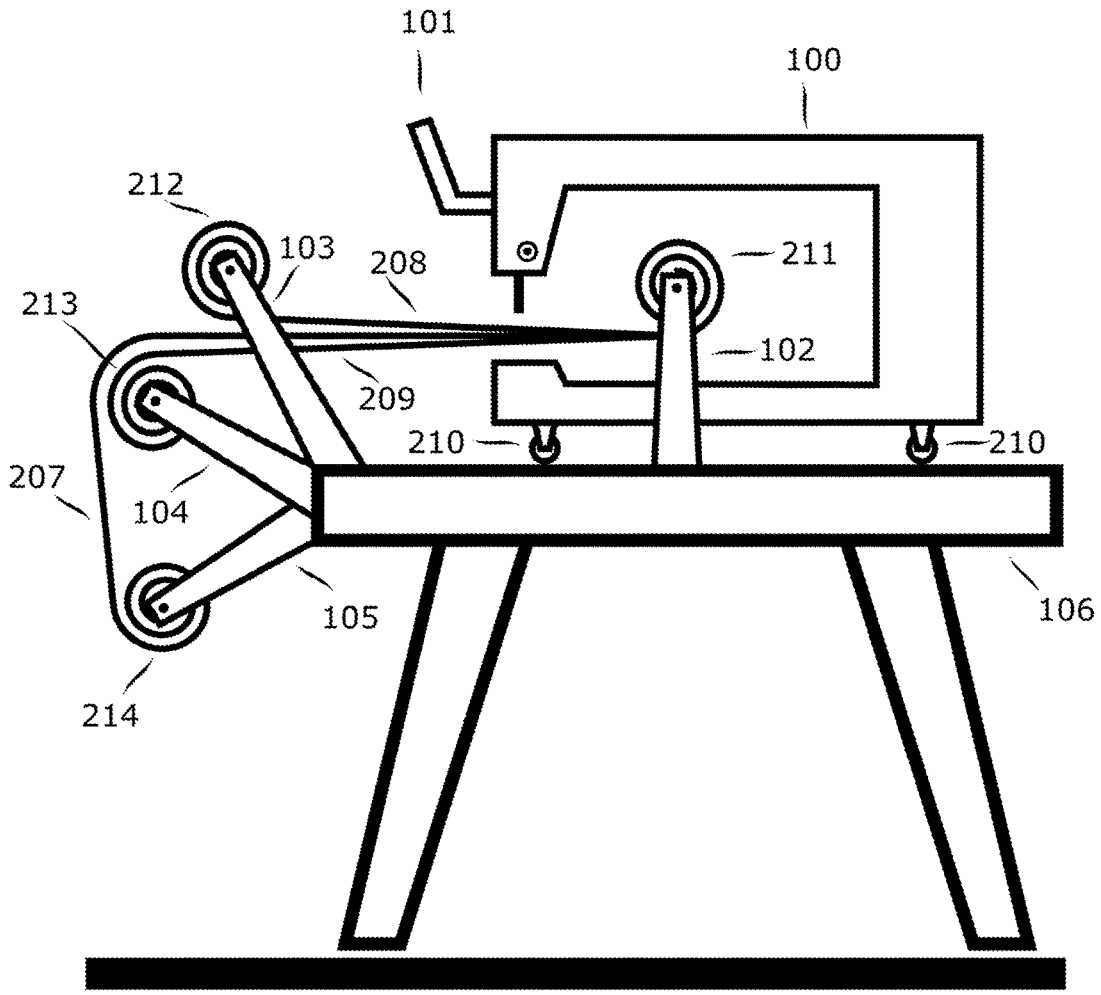
FIG. 2 (Prior Art) is a side-view of a longarm quilting machine, showing a conventional configuration in which the top, batting, and back layers are stored on rollers, and a take-up roller gathers the finished quilt.
Figure 3:
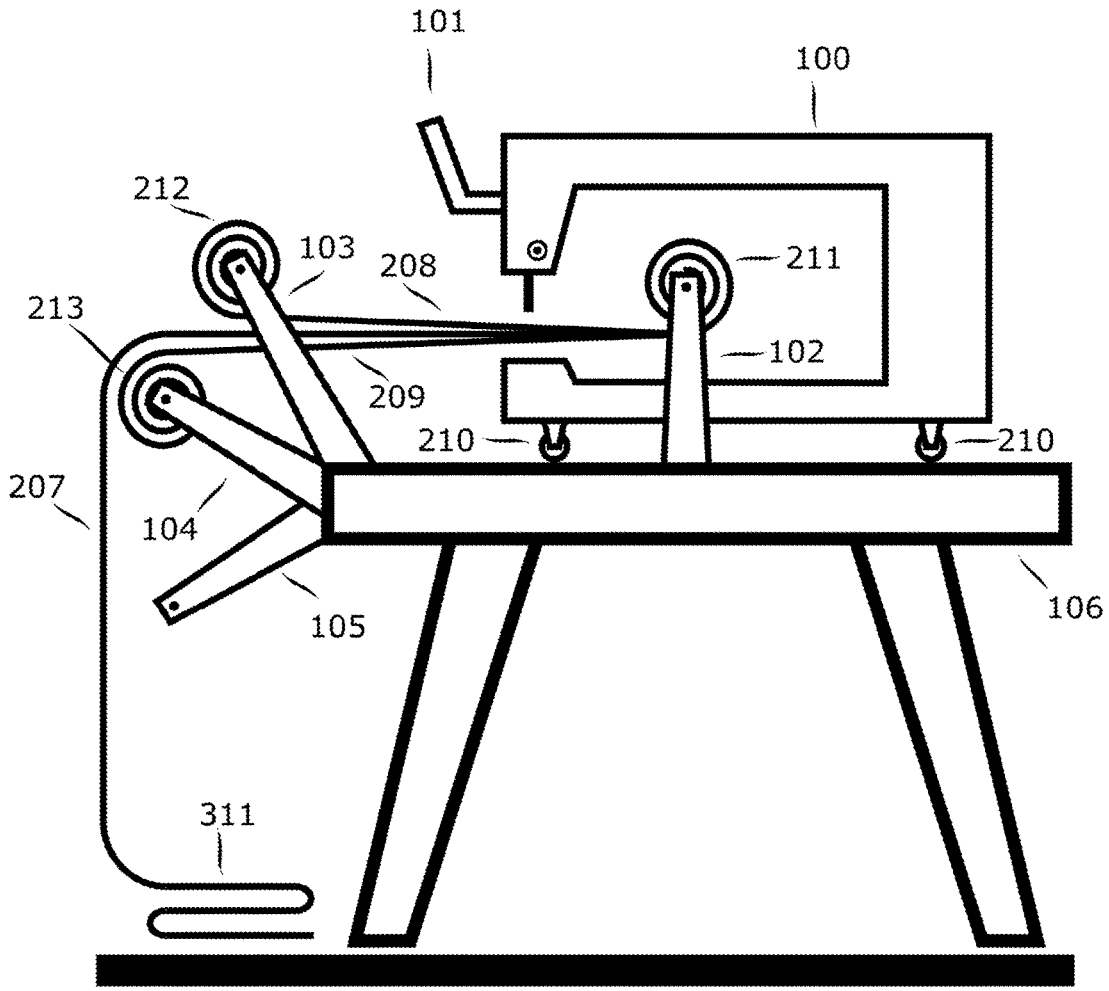
FIG. 3 (Prior Art) is a side-view of a longarm quilting machine, showing a conventional configuration in which the top and back layers are stored on rollers, while the batting layers hangs to the floor and a take-up roller gathers the finished quilt.
Figure 4:
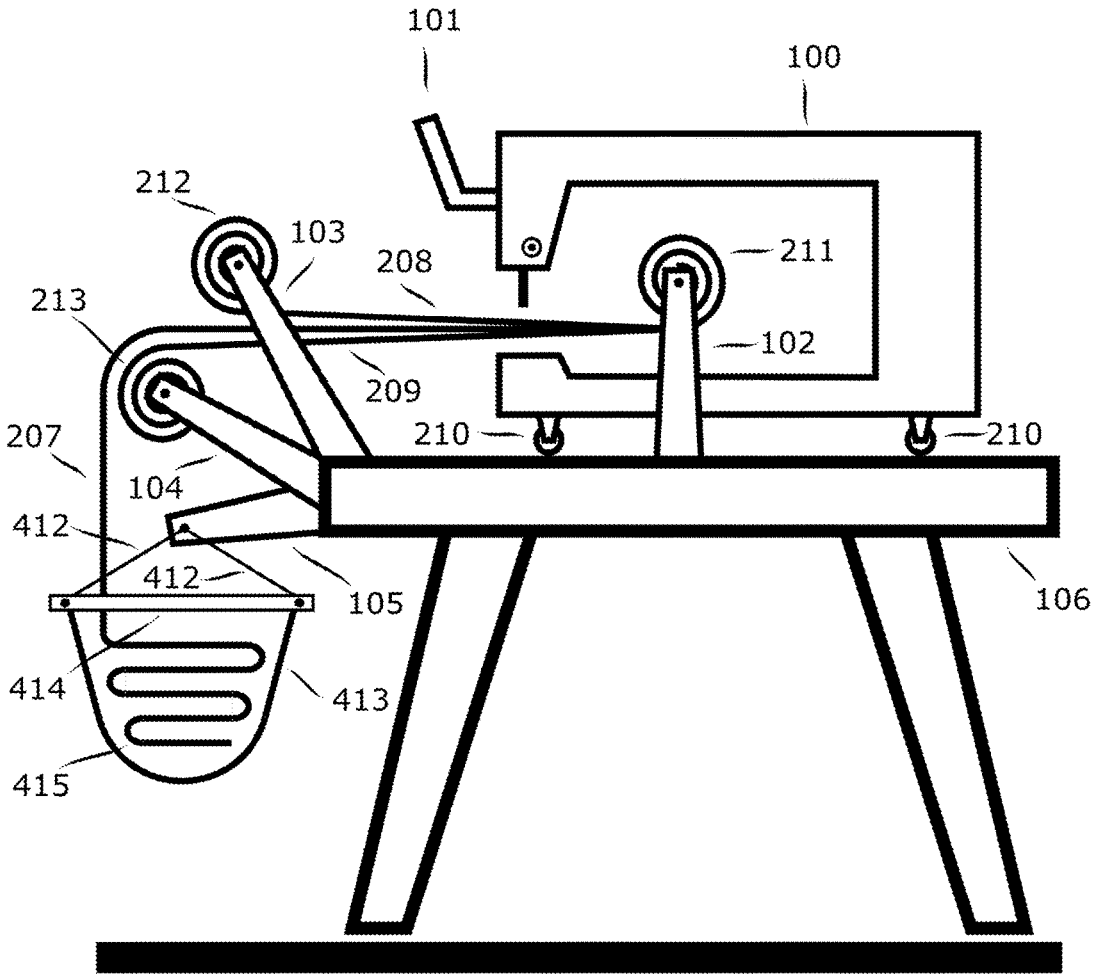
FIG. 4 is a side-view of the current invention, showing the batting layer folded inside a hammock that feeds the batting into the machine at constant low tension, while keeping it off the floor.

Referring to FIG. 4, the present invention comprises a longarm sewing machine 100 steerable with handles 101, and resting on a table 106. As in a conventional longarm quilting machine shown in FIGS. 1 and 2, the longarm sewing machine rests on wheels 210 which allow the longarm sewing machine to be moved towards and away from the operator, between the supply rollers 108, 109 and 110, and the take-up roller 107. Additional wheels allow travel in a transverse direction. Support arms 102 carry a take-up roller 107 to received the finished quilt, which is comprised of three layers: The top layer 208, the batting insulation layer 207, and the bottom layer 209. Support arms 102 carry a take-up roller 107 which carries the finished quilt 211; support arms 103 carry a supply roller 108, which carries the top-layer supply roll 212; and support arms 104 carry a supply roller 109, which carries the bottom layer supply roll 213.

Support arms 105, in a prior art machine, would support a roller supplying the batting layer. By contrast, in the present invention the support arms 105 support a hammock that contains a folded-up supply of batting 415. The hammock comprises a fabric body 413 that holds the batting 415. The hammock mouth is held open by a rigid mouth brace 414 at each end. Each mouth brace 414 is suspended by wires 412 from the support 105 that would have supported the batting supply roller 110 in the conventional prior art.

The current invention provides numerous benefits over the conventional prior art:

1) The batting material 207 is automatically fed into the quilting frame without any effort from the operator.
2) The weight of the batting material 207 automatically provides the correct tensioning, in contrast to the conventional supply roller 110, which may provide too much or too little tension.
3) The batting material 207 is easily loaded into the hammock 413. The hammock holds a substantial amount of batting in a folded configuration 415.
4) The batting material 207 is held off the floor, in contrast to a conventional prior art, which allows it to pile onto the floor. This keeps it clean and prevents it from being stepped on by the operator.

I claim:

1. A quilting machine comprising:

a longarm sewing machine,
a quilt-top supply roller,
a quilt-top,
a batting supply hammock,
a batting,
a backing supply roller,
a backing;
and a take-up roller,
wherein the batting supply hammock comprises
a left hammock mouth brace,
a right hammock mouth brace,
a left hammock support wire,
a right hammock support wire,
a hammock fabric;
wherein the hammock fabric comprises a left front corner, a right front corner, a left rear corner, and a right rear corner;
wherein the quilt-top supply roller, the batting supply hammock, and the backing supply roller are configured to sandwich the batting between the quilt-top and the backing to form an unstitched quilt;
wherein the longarm sewing machine is configured to stitch the unstitched quilt to form a stitched quilt;
wherein the quilting machine is configured to roll the stitched quilt onto the take-up roller;
wherein the left hammock mouth brace is configured to maintain a separation between the left front corner of the hammock fabric and the left rear corner of the hammock fabric;
wherein the right hammock mouth brace is configured to maintain a separation between the right front corner of the hammock fabric and the right rear corner of the hammock fabric;
wherein the right hammock mouth brace hangs from the right hammock support wire;
wherein the left hammock mouth brace hangs from the left hammock support wire;
wherein the batting is in a folded configuration in the batting supply hammock, and
wherein the batting supply hammock is configured to feed the batting in a state of low tension.

* * * * *